US010906727B2

(12) United States Patent
Mashima

(10) Patent No.: US 10,906,727 B2
(45) Date of Patent: Feb. 2, 2021

(54) SQUEEZE CONTAINER

(71) Applicant: RUAN CO., LTD., Tokyo (JP)

(72) Inventor: Tsuyoshi Mashima, Tokyo (JP)

(73) Assignee: RUAN CO., LTD., Tokyo (JP)

( * ) Notice: Subject to any disclaimer, the term of this patent is extended or adjusted under 35 U.S.C. 154(b) by 0 days.

(21) Appl. No.: 16/702,540

(22) Filed: Dec. 4, 2019

(65) Prior Publication Data

US 2020/0148456 A1 May 14, 2020

Related U.S. Application Data

(63) Continuation of application No. PCT/JP2019/033851, filed on Aug. 29, 2019.

(30) Foreign Application Priority Data

Oct. 30, 2018 (JP) ..... 2018-203583

(51) Int. Cl.
*B65D 83/00* (2006.01)
*B65D 47/06* (2006.01)
*B65D 83/06* (2006.01)

(52) U.S. Cl.
CPC ..... *B65D 83/0055* (2013.01); *B65D 47/06* (2013.01); *B65D 83/06* (2013.01)

(58) Field of Classification Search
CPC ..... B65D 83/0055; B65D 47/06; B65D 83/06
USPC ..... 222/211
See application file for complete search history.

(56) References Cited

U.S. PATENT DOCUMENTS 263,451 A * 8/1882 Adams ..... 128/203.15
2,450,205 A * 9/1948 Rose ..... B05B 11/045 222/632
2,840,277 A * 6/1958 Bach ..... B05B 11/045 222/633
2,896,825 A * 7/1959 Jackson ..... B05B 11/042 222/211

(Continued)

FOREIGN PATENT DOCUMENTS

JP S40-6376 Y 2/1965
JP S57-187679 U 11/1982
JP 2000-118579 A 4/2000

OTHER PUBLICATIONS

International Search Report for PCT/JP2019/033851 dated Oct. 8, 2019.
PCT written opinion dated Oct. 8, 2019.

*Primary Examiner* — Michael J. Melaragno
(74) *Attorney, Agent, or Firm* — Yokoi & Co., U.S.A.; Toshiyuki Yokoi

(57) ABSTRACT

A squeeze container capable of preventing a clogging caused by a powdery content is provided. The squeeze container capable of discharging a powdery content to an outside of the squeeze container, the squeeze container having two tubes suspended down to the inside of a container body to serve as through holes of the powdery content, the tip of one tube of the two tubes is fixed to one hole formed on an upper surface of the cylindrical body, the tip of the other tube passes through the other hole formed on the upper surface of the cylindrical body and extends to an internal space of the cylindrical body, and a gap is formed between a bottom of the container body and the opening of the cylindrical body so that the powdery content can enter into the internal space of the cylindrical body.

17 Claims, 8 Drawing Sheets

(56) References Cited

U.S. PATENT DOCUMENTS

| | | | | | |
|---|---|---|---|---|---|
| 3,185,352 | A | | 5/1965 | Ghisolfi | |
| 4,007,858 | A | * | 2/1977 | Shay | A45D 33/02 222/633 |
| 4,014,468 | A | * | 3/1977 | Silverman | B05B 11/043 239/327 |
| 4,015,753 | A | * | 4/1977 | Bennett | B05B 11/045 222/633 |
| 4,087,023 | A | * | 5/1978 | Szczepanski | B05B 11/046 222/209 |
| 4,091,966 | A | * | 5/1978 | Laauwe | B05B 11/0059 222/211 |
| 4,122,979 | A | * | 10/1978 | Laauwe | B05B 11/0059 222/633 |
| 4,307,823 | A | * | 12/1981 | Heiss | B05B 11/062 222/211 |
| 4,730,751 | A | * | 3/1988 | Mackles | B05B 11/045 222/211 |
| 5,884,621 | A | * | 3/1999 | Matsugi | A61M 11/00 128/203.15 |
| 5,971,234 | A | * | 10/1999 | Mathison | B05B 11/045 222/211 |
| 9,708,093 | B2 | * | 7/2017 | Romanov | G01F 11/261 |
| 2008/0277425 | A1 | * | 11/2008 | Grasser | B01F 15/0087 222/190 |

* cited by examiner

SQUEEZE CONTAINER

CROSS-REFERENCES TO RELATED APPLICATIONS

This application claims the benefit of priority and is a Continuation application of the prior International Patent Application No. PCT/JP2019/033851, with an international filing date of Aug. 29, 2019, which designated the United States, and is related to the Japanese Patent Application No. 2018-203583, filed Oct. 30, 2018, the entire disclosures of all applications are expressly incorporated by reference in their entirety herein.

BACKGROUND OF THE INVENTION

1. Field of the Invention

The present invention relates to a squeeze container capable of discharging powdery content to the outside when a user presses a side surface of the squeeze container.

2. Description of Related Art

A squeeze container (flexible container) which accommodates powdery content in a container and allows a user to discharge the powdery content to the outside by pressing a side surface of the container is one of the conventionally well-known containers.

The greatest disadvantage of the above described squeeze container is that only one set of tube and nozzle is provided for discharging and sucking air. Therefore, the powdery content is apt to stagnate in the tube and the nozzle to cause clogging. For example, Japanese Patent Application Laid-Open No. 2000-118579 (Patent Document 1) discloses a flexible container in which a cylindrical discharge passage connected to a discharge nozzle is provided and a communication hole is provided in a cylindrical wall of the cylindrical discharge passage.

However, in the above described structure, since the air is discharged and sucked by using one opening of the discharge nozzle, the powdery content tends to stay and clog when the powdery content moves back and forth in the discharge nozzle. Patent Document 1 tells that the user can eliminate the clogging by, for example, tapping around the discharge nozzle even if the discharge nozzle is clogged with the powdery content. However, the action of applying such a physical impact to the container is not preferable because it leads to breakage of the discharge nozzle or the container.

Furthermore, depending on the degree of clogging of the powdery content, only air may pass through the gap of the clogged powdery content. In that case, the user cannot judge whether the powdery content is completely consumed or the container is broken.

Japanese Patent Application Laid-Open No. 2000-118579

BRIEF SUMMARY OF THE INVENTION

The present invention aims for providing a squeeze container capable of suppressing the clogging of the powdery content caused in the above described prior art as much as possible.

In order to achieve the above described purpose, the first invention of the present application provides a squeeze container capable of discharging a powdery content to an outside of the squeeze container by pressing a side surface of the squeeze container, the squeeze container having: a container body for accommodating the powdery content, the container body having flexibility; and a nozzle cap detachably attached to the container body, wherein the nozzle cap has two tubes and a nozzle for discharging the powdery content to the outside, the two tubes being suspended down to the inside of the container body to serve as through holes of the powdery content, one end of the two tubes communicates with the nozzle, the other end of the two tubes is connected to a cylindrical body having an opening toward a bottom portion of the container body, the tip of the other end of one tube of the two tubes is fixed to one hole formed on an upper surface of the cylindrical body, the tip of the other end of the other tube of the two tubes passes through the other hole formed on the upper surface of the cylindrical body and extends to an internal space of the cylindrical body, a gap is formed between the bottom portion of the container body and the opening of the cylindrical body so that the powdery content can enter into the internal space of the cylindrical body, an upper surface of the nozzle cap is formed in an open space, and a top cap for sealing the open space is detachably attached to the nozzle cap.

In order to achieve the above described purpose, the second invention of the present application provides a squeeze container capable of discharging a powdery content to an outside of the squeeze container by pressing a side surface of the squeeze container, the squeeze container having: a container body for accommodating the powdery content, the container body having flexibility; and a nozzle cap detachably attached to the container body, wherein the nozzle cap has two tubes and a nozzle for discharging the powdery content to the outside, the two tubes being suspended down to the inside of the container body to serve as through holes of the powdery content, one end of the two tubes communicates with the nozzle, the other end of the two tubes is connected to a cylindrical body having an opening toward a bottom portion of the container body, the cylindrical body includes a main cylindrical body and a small cylindrical body provided in an internal space or outside the internal space of the main cylindrical body, the small cylindrical body having a diameter smaller than the diameter of the main cylindrical body, the tip of the other end of one tube of the two tubes is fixed to a main cylindrical body side hole formed on an upper surface of the main cylindrical body, the tip of the other end of the other tube of the two tubes is fixed to a small cylindrical body side hole formed on the small cylindrical body, a gap is formed between the bottom portion of the container body and the opening of the main cylindrical body so that the powdery content can enter into the internal space of the main cylindrical body, an upper surface of the nozzle cap is formed in an open space, and a top cap for sealing the open space is detachably attached to the nozzle cap.

In order to achieve the above described purpose, the third invention of the present application provides a squeeze container capable of discharging a powdery content to an outside of the squeeze container by pressing a side surface of the squeeze container, the squeeze container comprising: a container body for accommodating the powdery content, the container body having flexibility; and a nozzle cap detachably attached to the container body, wherein the nozzle cap has two tubes and a nozzle for discharging the powdery content to the outside, the two tubes being suspended down to the inside of the container body to serve as through holes of the powdery content, one end of the two tubes communicates with the nozzle, the tip of the other end of one tube of the two tubes is fixed to a hole formed on an upper surface of a cylindrical body having an opening toward a bottom portion of the container body, the other tube is longer than the one tube, the other tube is fixed to an outer surface of the cylindrical body or freely suspended along the outer surface of the cylindrical body, a gap is formed between the bottom portion of the container body and the opening of the cylindrical body so that the powdery content can enter into an internal space of the cylindrical body, an upper surface of the nozzle cap is formed in an open space, and a top cap for sealing the open space is detachably attached to the nozzle cap.

According to the squeeze container of each invention of the present application, two tubes (two paths) are provided for the discharge flow path of the powdery content and the overall lengths of two flow paths are set to be different from each other (i.e., set to long and short). Thus, a difference occurs in the air pressure generated between the two tubes when the user performs a squeeze operation to contract or expand the container body. Consequently, the discharge of air and sucking of air can be done by using different paths.

Namely, when the user presses the side surface of the container body, the air in the container body is discharged to the outside through both tubes. At this time, however, the pressure becomes higher in one tube having the shorter flow path length than the pressure in the other tube having the longer flow path length. Thus, the powdery content mainly passes through the one tube having the shorter flow path length and is discharged to the outside direction (discharge direction) of the container body vigorously. Conversely, when the pressed container body is restored to its original shape, the outside air flows into the container through both tubes. However, the pressure in the other tube having the longer flow path length becomes lower than the pressure in the one tube having the shorter flow path length. Thus, the outside air is sucked into the container body mainly through the other tube having the longer flow path length. As explained above, the discharge is mainly performed by one tube and the sucking is mainly performed by the other tube. Thus, the clogging caused by the stagnation of the powdery content in each tube can be suppressed.

In addition, according to the present invention, since the cylindrical body is connected to the tip of the one tube having the short flow path length, when the user presses the side surface of the container body, the powdery content is finely and separately stirred up in the internal space of the cylindrical body by the airflow generated in the internal space of the cylindrical body and moved to the nozzle while passing through the tube. Thus, the powdery content can be prevented from being supplied to the tube and the nozzle in a state of being solidified. Consequently, the discharge of the powdery content accommodated in the container body can be performed more stably.

In the second invention of the present application, since the other tube is connected to the small cylindrical body and the flow path length is longer than the flow path length of the one tube, the second invention also exhibits the same operation and effect as those of the first invention and the third invention.

DETAILED DESCRIPTION OF THE INVENTION

Hereafter, the embodiments of the present invention will be explained with reference to FIGS. 1 to 8.

Figure 1:
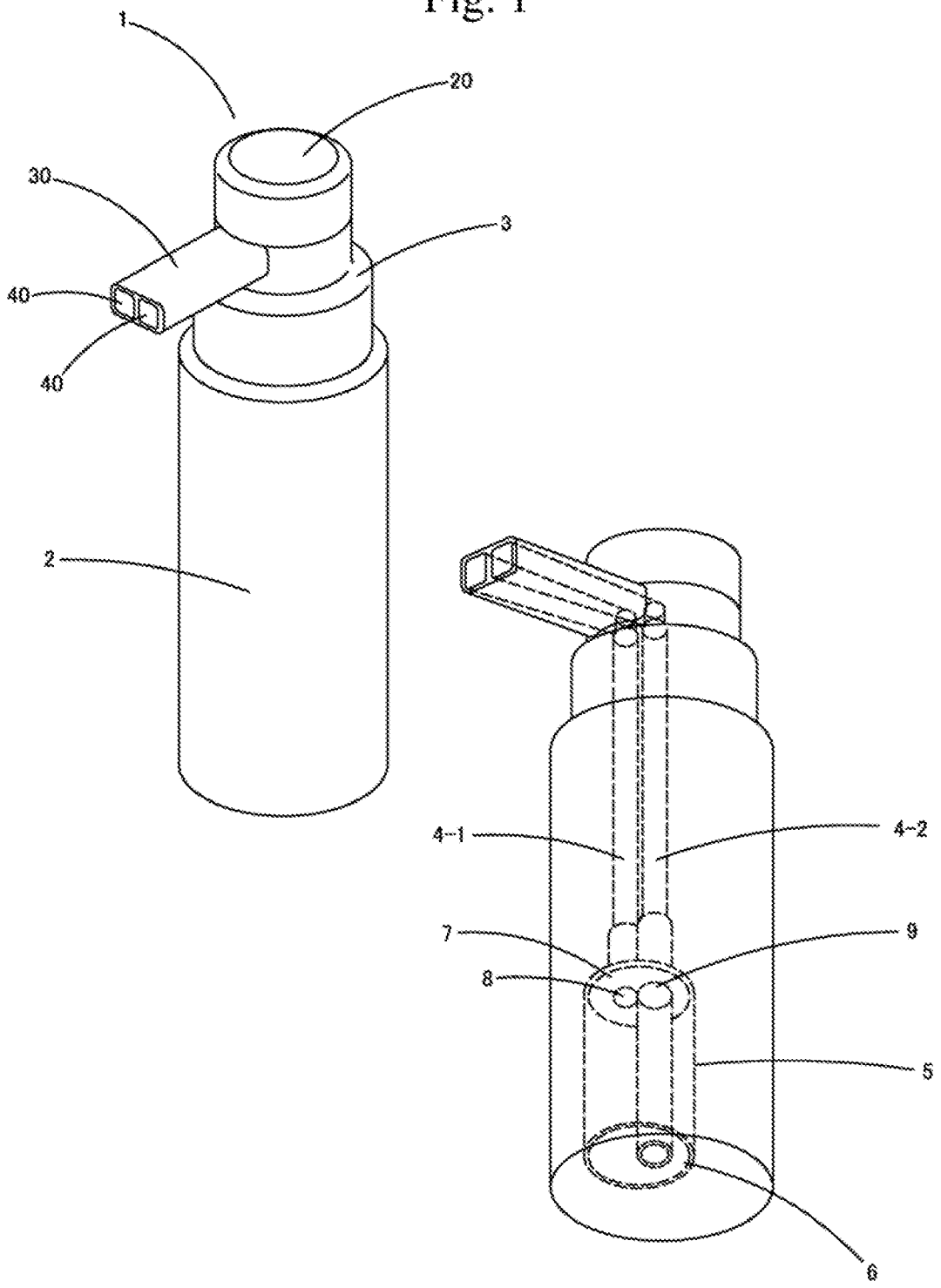
FIG. 1 is a perspective view of a squeeze container according to the first embodiment of the present invention.

FIG. 1 shows overall perspective views of a squeeze container 1 according to the first embodiment. The broken lines show the internal structure seen thorough. Note that the overall basic structure of the squeeze container 1 is the same in all embodiments.

As shown in FIG. 1, the squeeze container 1 includes a cylindrical container body 2 formed of a deformable resin material having a flexibility, a nozzle cap 3 attached to the container body 2, and a top cap 20 attached to the nozzle cap 3. In addition, two tubes suspended down to the inside of the container main body 2 are fixed to the nozzle cap 3. A nozzle 30 communicated with and connected to the two tubes is formed so as to protrude outward. The nozzle 30 can be integrally formed with the nozzle cap 3, or can be formed separately and detachably attached to the nozzle cap 3.

The container body 2 accommodates a content (powdery content, powdery object) made of powder such as artificial hair fibers. However, since two tubes are suspended down to the container body 2, if the powdery content is packed into the container body 2 first, the tube cannot be pushed successfully and extra powder enters into the tube. Therefore, the nozzle cap 3 is first attached to the container body 2, and then the powder is filed into the container body 2.

At this time, since an open space is formed on the upper surface of the nozzle cap 3, a necessary amount of powdery content is filled into the container body 2 from the open space. After the filling of the powdery content is completed, the upper portion of the nozzle cap 3 is sealed with the top cap 20. Thus, the squeeze container 1 is prepared to be shipped as a product. The same applies to the case where the user fills the contents for replenishment by himself/herself after the contents are completely consumed. The top cap 20 can be attached to the nozzle cap 3 by using a screw type or a press-fit type attaching means.

As shown in the figures, the tips of the two tubes are connected to a cylindrical body 5 which has an opening 6 at its tip and which is open towards the bottom portion of the container body 2. The upper surface 7 (i.e., bottom surface when the cylindrical body is arranged in a state that the opening 6 is directed upward) of the cylindrical body 5 having two holes, which are one hole 8 and the other hole 9 respectively corresponding to the two tubes. The tip of one tube 4-1 of the two tubes is connected to the one hole 8, and the tip of the other tube 4-2 passes through the other hole 9 and extends to an internal space of the cylindrical body 5. Namely, the flow path length of the one tube 4-1 is configured to be shorter than the flow path length of the other tube 4-2. Note that the two tubes are made of the same tube and the lengths of the tubes are different from each other (the inner diameter is the same). The material of the tube can be a soft material or a hard material without being particularly limited.

Figure 2:
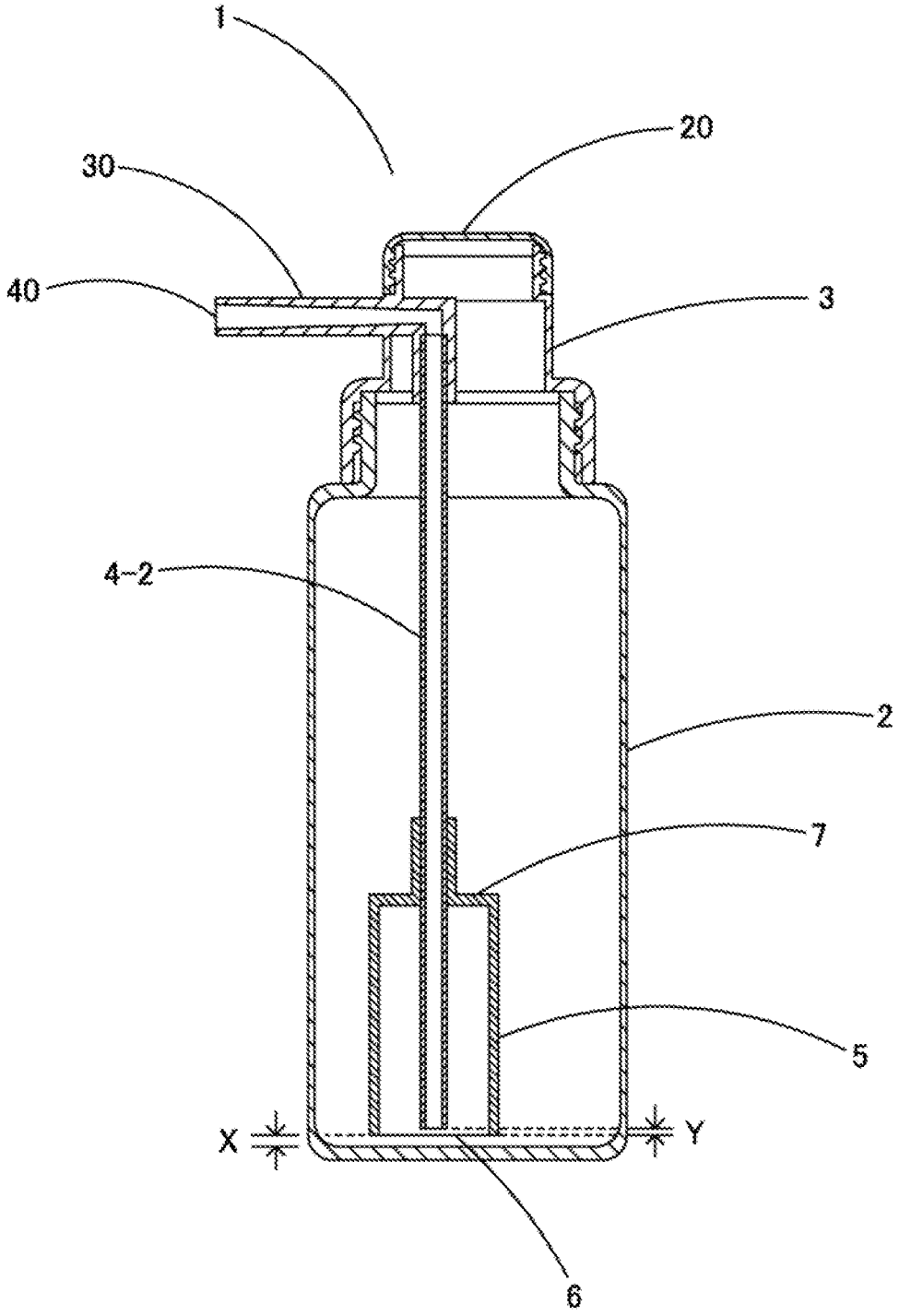
FIG. 2 is a cross-sectional view of a squeeze container according to the first embodiment of the present invention.

As shown in the cross-sectional view of FIG. 2, a slight gap X is formed between the opening 6 of the cylindrical body 5 and the bottom portion of the container body 2 so that the powdery content can enter into the gap X, and a clearance Y is formed between the tip of the other tube 4-2 and the opening 6 of the cylindrical body 5. The clearance Y is preferably within a range from a vicinity of the inside (inside in the inside direction of the cylindrical body 5) of the opening 6 of the cylindrical body 5 to a middle of the internal space of the cylindrical body 5.

Two flow paths are formed inside the nozzle 30, and are connected to the one tube 4-1 and the other tube 4-2 respectively. The tip of the nozzle forms a discharge port 40 from which two flow path ends are exposed.

The method of using the squeeze container 1 having the above described configuration and the discharge operation of the powdery content will be explained.

When the user discharges the powdery content accommodated in the container body 2 to the outside, the user squeezes the side surface of the container body 2 strongly so as to pinch the container body 2 between the thumb and other fingers. At this time, the air inside the container body 2 is compressed to increase the air pressure and an air flow is generated in the internal space of the cylindrical body 5. Thus, the powdery content existing in the periphery is finely and separately stirred up in the internal space.

Furthermore, although the air pressure is different between the inside of the one tube 4-1 connecting the container body 2 and the outside air and the inside of the other tube 4-2 connecting the container body 2 and the outside air, the internal pressure of the one tube 4-1 having the shorter flow path length becomes higher than the internal pressure of the other tube 4-2 having the longer flow path length. Thus, the majority of the powdery content passes through the inside of the one tube 4-1 and is discharged to the outside from the discharge port 40. (Of course, some of the powdery content passes through the inside of the other tube 4-2 and then is discharged to the outside, but the one tube 4-1 serves as a main discharge path.)

When the discharge of the powdery content is completed and the user releases the pinched fingers, the container body 2 returns to its original shape by its own restoring force. At the time of the above described restoration, the internal pressure of the container body 2 becomes low and the outside air flows into the inside of the container body 2 from the discharge port 40. However, since the internal pressure of the other tube 4-2 having the longer flow path length becomes lower than the internal pressure of the one tube 4-1 having the shorter flow path length. Thus, the majority of the outside air flows into the container body 2 through the inside of the other tube 4-2. (Of course, some of the outside air flows into the container body 2 through the inside of the one tube 4-1, but the other tube 4-2 serves as a main suction path.)

In the embodiment described above, the inner diameter of the one tube 4-1 and the inner diameter of the other tube 4-2 are substantially the same (tube having the same specification is used). However, according to experiments, the same operation can be expected if the inner diameter of the one tube 4-1 is within a range of 0.7 to 1.5 times the inner diameter of the other tube 4-2.

The horizontal cross-sectional shape of the cylindrical body 5 is not limited to circular, and can be elliptical or polygonal.

Next, second to fourth embodiments of the present invention will be explained. As described above, the overall basic structure of the squeeze container 1 is the same in all embodiments. The difference between the embodiments is the specific configurations of the one tube 4-1, the other tube 4-2 and the cylindrical body 5.

Figure 3:
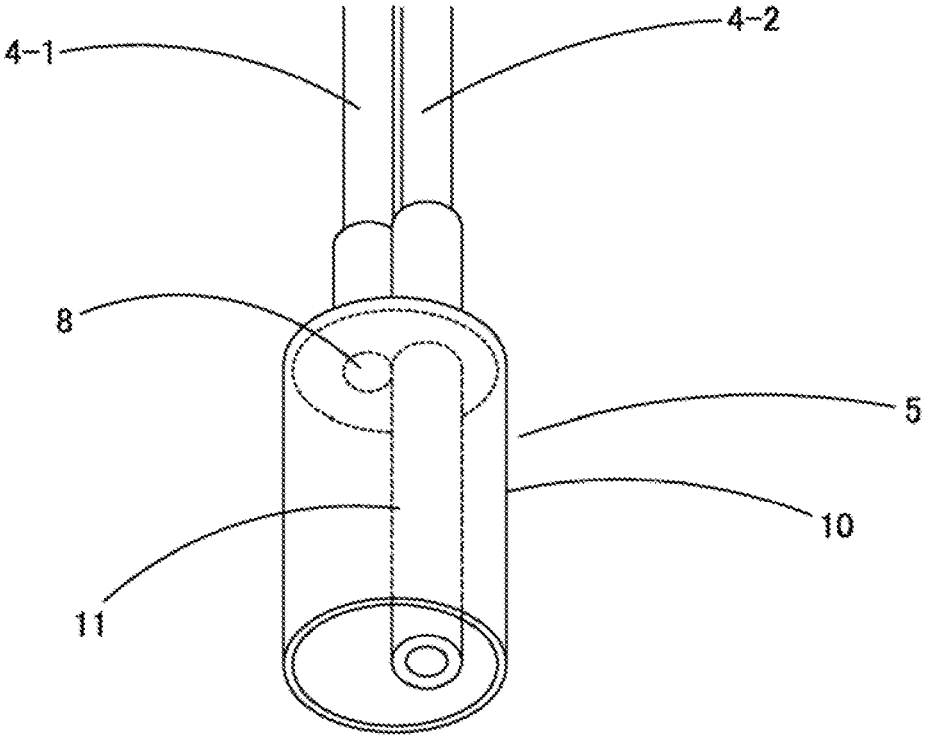
FIG. 3 is a perspective view of a cylindrical body according to the second embodiment.
Figure 4:
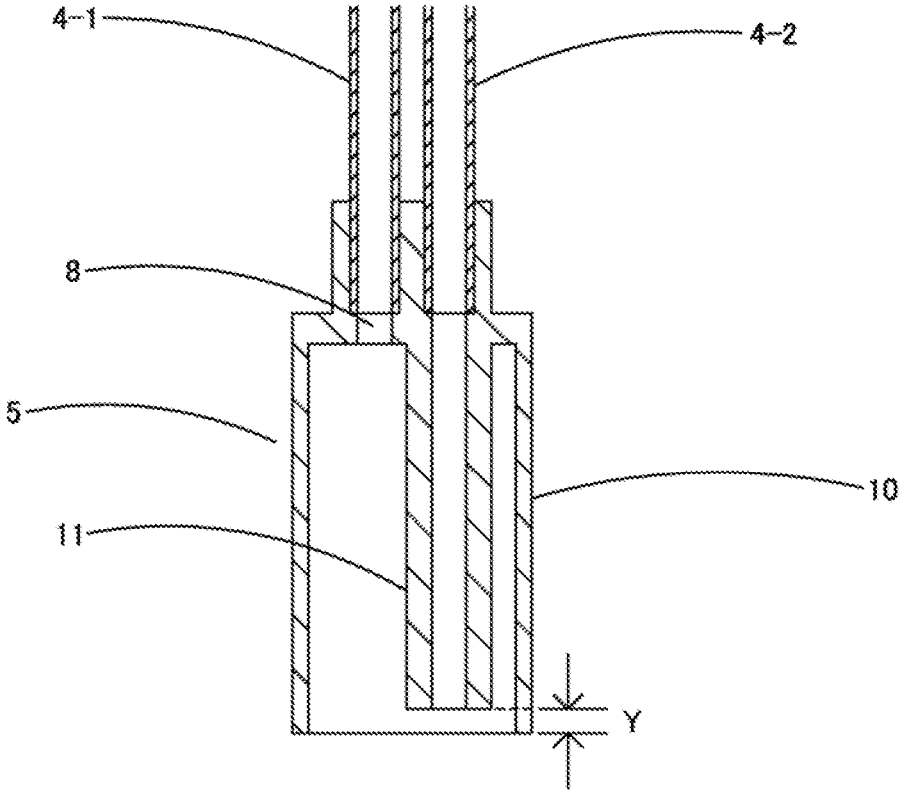
FIG. 4 is a cross-sectional view of a cylindrical body according to the second embodiment.

FIG. 3 is a perspective view showing the configuration of the second embodiment, and FIG. 4 is a cross-sectional view thereof. The cylindrical body 5 is composed of a main cylindrical body 10 having a large diameter and a small cylindrical body 11 having a smaller diameter than the diameter of the main cylindrical body 10. The small cylindrical body 11 is provided in the internal space of the main cylindrical body 10. One end of the small cylindrical body 11 is opened toward the bottom portion of the main cylindrical body 10, and the other end is faced with the opening of the main cylindrical body 10. Although the main cylindrical body 10 and the small cylindrical body 11 are integrally formed of resin, they can be separately formed and fixed by an adhesive material.

The positional relationship between the other end of the small cylindrical body 11 and the opening of the main cylindrical body 10 is the same as "the clearance Y between the tip of the other tube 4-2 and the opening 6 of the cylindrical body 5" in the first embodiment.

The tip of the one tube 4-1 is connected to a hole provided on the upper surface of the main cylindrical body 10, and the tip of the other tube 4-2 is connected to one end of the small cylindrical body 11. The flow path length passing through the other tube 4-2 is the sum of the length of the other tube 4-2 and the length of the small cylindrical body 11.

Namely, in the second embodiment, while the one tube 4-1 and the other tube 4-2 are used as the same length, the length of the flow path passing through the one tube 4-1 and the length of the flow path passing through the other tube 4-2 are made different by the small cylindrical body provided inside the main cylindrical body 10.

Figure 5:
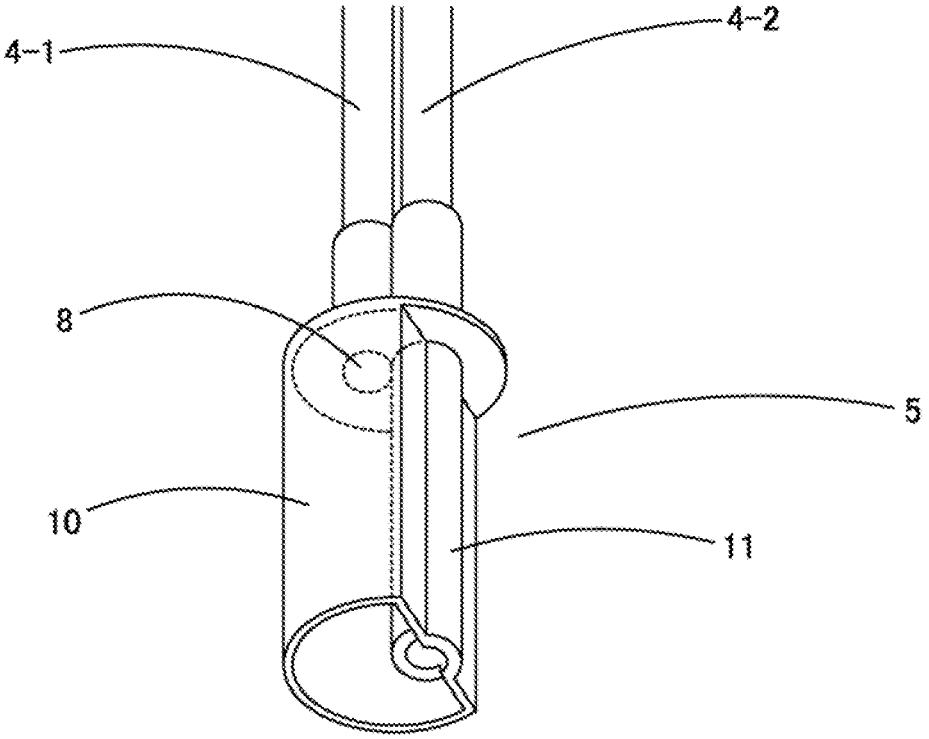
FIG. 5 is a perspective view of a cylindrical body according to the third embodiment.
Figure 6:
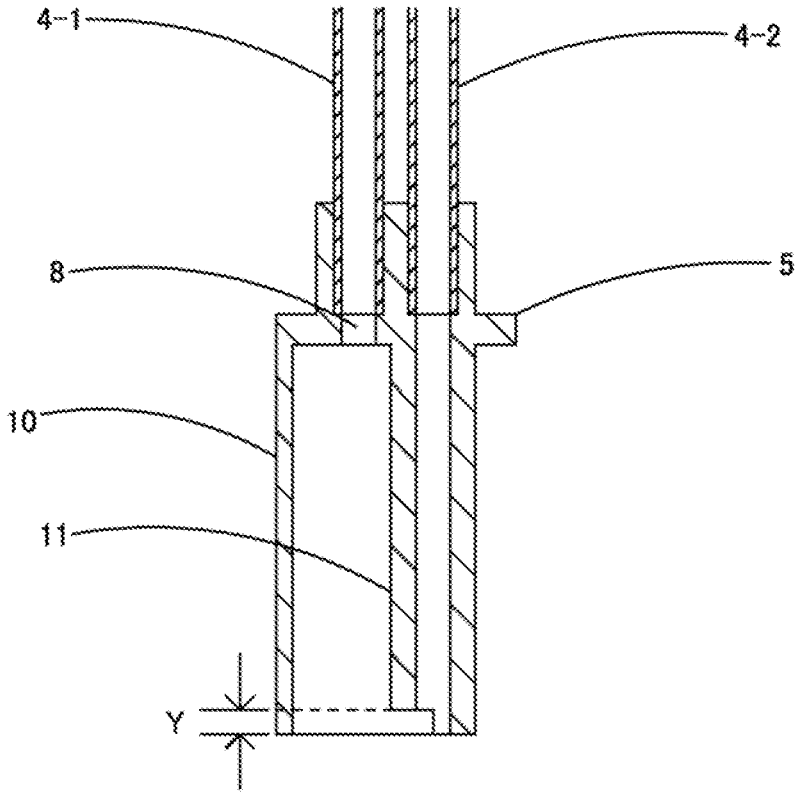
FIG. 6 is a cross-sectional view of a cylindrical body according to the third embodiment.

FIG. 5 is a perspective view showing the configuration of the third embodiment, and FIG. 6 is a cross-sectional view thereof. The third embodiment is different from the second embodiment in that the cylindrical body 5 is composed of a main cylindrical body 10 and a small cylindrical body 11 provided on the outer surface of the main cylindrical body 10.

One end of the small cylindrical body 11 is opened to the outside of the upper surface of the main cylindrical body 10, and the other end faces the vicinity of the opening of the main cylindrical body 10. Although the main cylindrical body 10 and the small cylindrical body 11 are integrally formed of resin, they can be formed separately and fixed by an adhesive material or the like. The positional relationship between the other end of the small cylindrical body 11 and the opening of the main cylindrical body 10 is the same as "the clearance Y between the tip of the other tube 4-2 and the opening 6 of the cylindrical body 5" in the first embodiment.

The tip of the one tube 4-1 is connected to a hole provided on the upper surface of the main cylindrical body 10, and the tip of the other tube 4-2 is connected to one end of the small cylindrical body 11. The flow path length passing through the other tube 4-2 is the sum of the length of the other tube 4-2 and the length of the small cylindrical body 11, similarly to the second embodiment.

Namely, in the third embodiment, similarly to the second embodiment, while the one tube 4-1 and the other tube 4-2 are used as the same length, the length of the flow path passing through the one tube 4-1 and the length of the flow path passing through the other tube 4-2 are made different by the small cylindrical body 11 provided inside the main cylindrical body 10.

Although the horizontal cross-sectional shape of the main cylindrical body 10 shown in FIGS. 5 and 6 is semicircular and a half of the small cylindrical body 11 is displaced (recessed) toward the internal space side of the main cylindrical body 10, the small cylindrical body 11 can be formed to be located completely outside the main cylindrical body 10. In addition, the horizontal cross-sectional shape of the main cylindrical body 10 can be circular, elliptical or polygonal.

Figure 7:
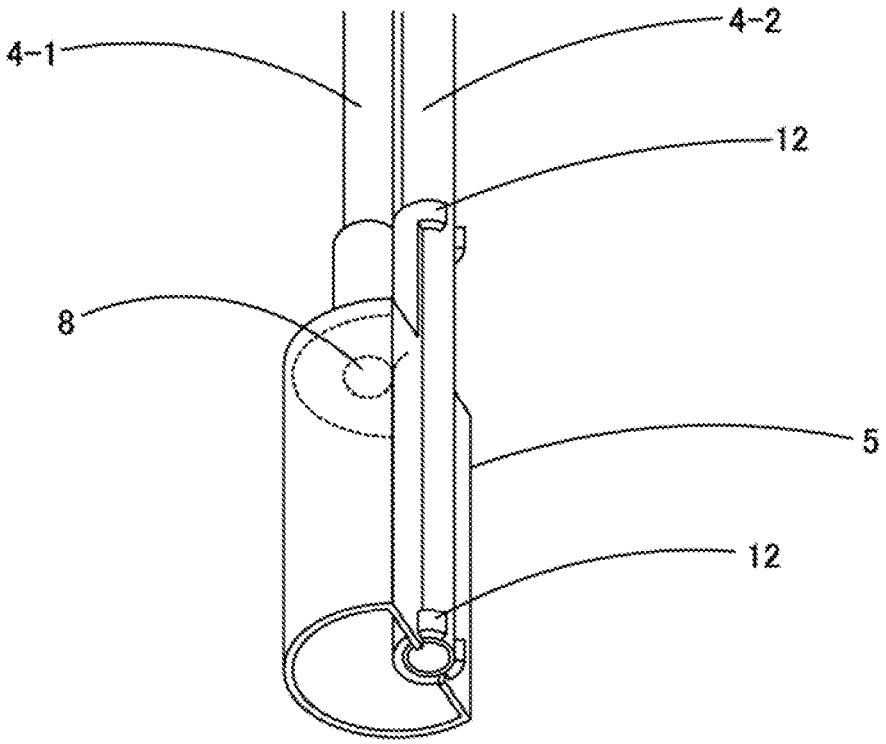
FIG. 7 is a perspective view of a cylindrical body according to the fourth embodiment.
Figure 8:
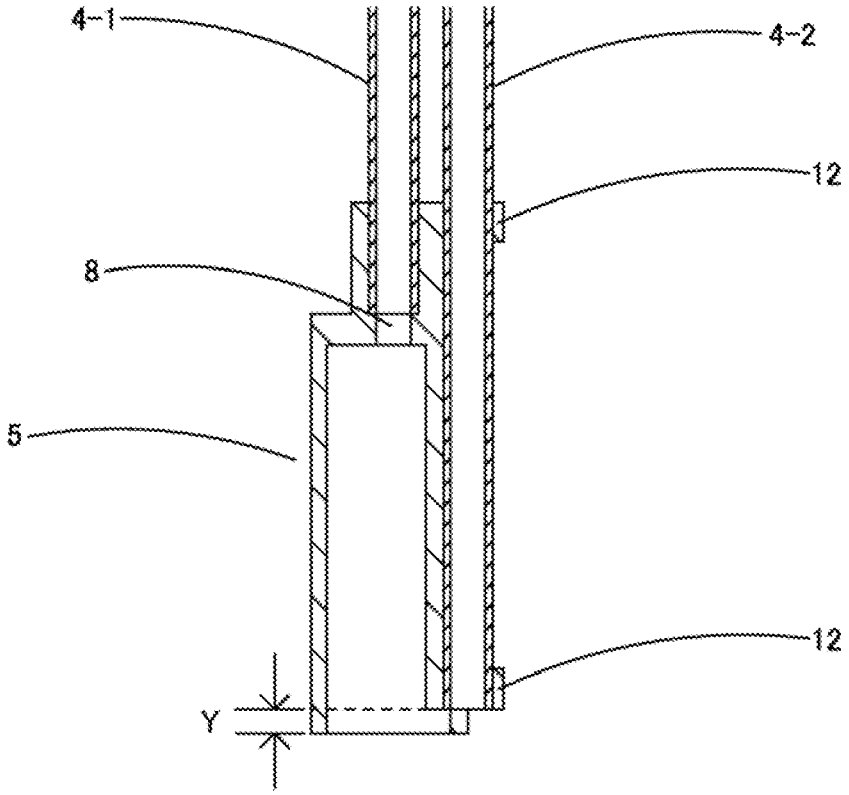
FIG. 8 is a cross-sectional view of a cylindrical body according to the fourth embodiment.

FIG. 7 is a perspective view showing the configuration of the fourth embodiment, and FIG. 8 is a cross-sectional view thereof. The present embodiment is different from the third embodiment in that the small cylindrical body 11 is not employed and the other tube 4-2 is fixed to the side surface of the cylindrical body 5 via a fixing portion 12.

The fixing portion 12 is a C-shaped claw provided on the side surface of the cylindrical body 5. The other tube 4-2 is press-fitted and fixed into the C-shaped claw.

The positional relationship between the tip of the other tube 4-2 and the opening of the cylindrical body 5 in the present embodiment is the same as "the clearance Y between the tip of the other tube 4-2 and the opening 6 of the cylindrical body 5" in the first embodiment.

Although the horizontal cross-sectional shape of the cylindrical body 5 shown in FIGS. 7 and 8 is semicircular and a half of the other tube 4-2 is displaced (recessed) toward the internal space side of the cylindrical body 5, the other tube 4-2 can be fixed to be located completely outside the cylindrical body 5. The horizontal cross-sectional shape of the cylindrical body 5 can be circular, elliptical or polygonal.

As a modification example of the present embodiment, the other tube 4-2 can be fixed by an adhesive material on the side surface of the cylindrical body 5 without providing the fixing portion 12. When the other tube is formed of a hard resin or the like, the other tube 4-2 can be freely suspended down along the side surface of the cylindrical body 5.

Since the usage of the squeeze container and the discharge operation of the powdery content described in the second to fourth embodiments are the same as those in the first embodiment, detailed explanation is omitted. In the second to fourth embodiments, the inner diameter of the one tube 4-1 and the inner diameter of the other tube 4-2 can be substantially the same (tube having the same specification) as in the first embodiment. The same operation can be expected if the inner diameter of the one tube 4-1 is within a range of 0.7 to 1.5 times the inner diameter of the other tube 4-2.

As described above, according to the squeeze container of each of the inventions of the present application, the main discharge and the main sucking can be performed by two different tube paths. Therefore, the clogging caused by the stagnation of the powdery content in the tube can be suppressed.

Furthermore, according to the squeeze container of each invention of the present application, since the cylindrical body is connected to the tip of the one tube having the short flow path length, when the powdery content is discharged, the powdery content can be prevented from being supplied to the tube and the nozzle in a state of being solidified. Thus, the powdery content can be discharged more stably.

DESCRIPTION OF REFERENCE SIGNS

1 squeeze container
2 container body
3 nozzle cap
4-1 one tube
4-2 the other tube
5 cylindrical body
6 opening
7 upper surface
8 one hole
9 the other hole
10 main cylindrical body
11 small cylindrical body
12 fixing portion
20 top cap
30 nozzle
40 discharge port

What is claimed is:

1. A squeeze container capable of discharging a powdery content to an outside of the squeeze container by pressing a side surface of the squeeze container, the squeeze container comprising:

a container body for accommodating the powdery content, the container body having flexibility; and a nozzle cap detachably attached to the container body, wherein the nozzle cap has two tubes and a nozzle for discharging the powdery content to the outside, the two tubes being suspended down to the inside of the container body to serve as through holes of the powdery content, one end of the two tubes communicates with the nozzle, the other end of the two tubes is connected to a cylindrical body having an opening toward a bottom portion of the container body, the tip of the other end of one tube of the two tubes is fixed to one hole formed on an upper surface of the cylindrical body, the tip of the other end of the other tube of the two tubes passes through another hole formed on the upper surface of the cylindrical body and extends to an internal space of the cylindrical body, a gap is formed between the bottom portion of the container body and the opening of the cylindrical body so that the powdery content can enter into the internal space of the cylindrical body, an upper surface of the nozzle cap is formed in an open space, and a top cap for sealing the open space is detachably attached to the nozzle cap.

2. The squeeze container according to claim 1, wherein the tip of the other end of the other tube extends to a range from a vicinity of the inside of the opening of the cylindrical body to a middle of the internal space of the cylindrical body.

3. A squeeze container capable of discharging a powdery content to an outside of the squeeze container by pressing a side surface of the squeeze container, the squeeze container comprising:

a container body for accommodating the powdery content, the container body having flexibility; and a nozzle cap detachably attached to the container body, wherein the nozzle cap has two tubes and a nozzle for discharging the powdery content to the outside, the two tubes being suspended down to the inside of the container body to serve as through holes of the powdery content, one end of the two tubes communicates with the nozzle, the other end of the two tubes is connected to a cylindrical body having an opening toward a bottom portion of the container body, the cylindrical body includes a main cylindrical body and a small cylindrical body provided in an internal space or outside the internal space of the main cylindrical body, the small cylindrical body having a diameter smaller than the diameter of the main cylindrical body, the tip of the other end of one tube of the two tubes is fixed to a main cylindrical body side hole formed on an upper surface of the main cylindrical body, the tip of the other end of the other tube of the two tubes is fixed to a small cylindrical body side hole formed on the small cylindrical body, a gap is formed between the bottom portion of the container body and the opening of the main cylindrical body so that the powdery content can enter into the internal space of the main cylindrical body, an upper surface of the nozzle cap is formed in an open space, and a top cap for sealing the open space is detachably attached to the nozzle cap.

4. The squeeze container according to claim 3, wherein the end of the opening side of the small cylindrical body is located within a range from a vicinity of the inside of the end of the opening side of the main cylindrical body to a middle of the main cylindrical body in a side view.

5. A squeeze container capable of discharging a powdery content to an outside of the squeeze container by pressing a side surface of the squeeze container, the squeeze container comprising:

a container body for accommodating the powdery content, the container body having flexibility; and a nozzle cap detachably attached to the container body, wherein the nozzle cap has two tubes and a nozzle for discharging the powdery content to the outside, the two tubes being suspended down to the inside of the container body to serve as through holes of the powdery content, one end of the two tubes communicates with the nozzle, the tip of the other end of one tube of the two tubes is fixed to a hole formed on an upper surface of a cylindrical body having an opening toward a bottom portion of the container body, the other tube of the two tubes is longer than the one tube, the other tube is fixed to an outer surface of the cylindrical body or freely suspended along the outer surface of the cylindrical body, a gap is formed between the bottom portion of the container body and the opening of the cylindrical body so that the powdery content can enter into an internal space of the cylindrical body, an upper surface of the nozzle cap is formed in an open space, and a top cap for sealing the open space is detachably attached to the nozzle cap.

6. The squeeze container according to claim 5, wherein the other tube is fixed to the side surface of the cylindrical body by an adhesive material when the other tube is fixed to the side surface of the cylindrical body.

7. The squeeze container according to claim 5, wherein the other tube is fixed by a tube fixing portion formed on the side surface of the cylindrical body when the other tube is fixed to the side surface of the cylindrical body.

8. The squeeze container according to claim 5, wherein the tip of the other end of the other tube extends to a range from a vicinity of the inside of the opening of the cylindrical body to a middle of the cylindrical body.

9. The squeeze container according to claim 1, wherein the nozzle has two nozzle holes corresponding to the one tube and the other tube on a one-to-one basis, and the tip of the nozzle holes forms a discharge port.

10. The squeeze container according to claim 3, wherein the nozzle has two nozzle holes corresponding to the one tube and the other tube on a one-to-one basis, and the tip of the nozzle holes forms a discharge port.

11. The squeeze container according to claim 5, wherein the nozzle has two nozzle holes corresponding to the one tube and the other tube on a one-to-one basis, and the tip of the nozzle holes forms a discharge port.

12. The squeeze container according to claim 1, wherein the inner diameter of the one tube is same as the inner diameter of the other tube.

13. The squeeze container according to claim 3, wherein the inner diameter of the one tube is same as the inner diameter of the other tube.

14. The squeeze container according to claim 5, wherein the inner diameter of the one tube is same as the inner diameter of the other tube.

15. The squeeze container according to claim 1, wherein the inner diameter of the one tube is within a range of 0.7 to 1.5 times the inner diameter of the other tube.

16. The squeeze container according to claim 3, wherein the inner diameter of the one tube is within a range of 0.7 to 1.5 times the inner diameter of the other tube.

17. The squeeze container according to claim 5, wherein the inner diameter of the one tube is within a range of 0.7 to 1.5 times the inner diameter of the other tube.

* * * * *